US008893796B2

(12) United States Patent
Conner et al.

(10) Patent No.: US 8,893,796 B2
(45) Date of Patent: Nov. 25, 2014

(54) WELLBORE VALVE ASSEMBLY

(76) Inventors: David Bell Conner, Highland (GB); Amr Salama Mohamed Salem Goweily, Cairo (EG)

( * ) Notice: Subject to any disclaimer, the term of this patent is extended or adjusted under 35 U.S.C. 154(b) by 286 days.

(21) Appl. No.: 13/427,482

(22) Filed: Mar. 22, 2012

(65) Prior Publication Data

US 2012/0305257 A1 Dec. 6, 2012

(30) Foreign Application Priority Data

Mar. 23, 2011 (GB) ..... 1104893.1

(51) Int. Cl.

| | |
|---|---|
| ***E21B 34/08*** | (2006.01) |
| ***E21B 21/10*** | (2006.01) |
| ***E21B 21/08*** | (2006.01) |
| *E21B 34/00* | (2006.01) |

(52) U.S. Cl.

CPC ..... *E21B 21/10* (2013.01); *E21B 21/08* (2013.01); *E21B 2034/005* (2013.01); *E21B 34/08* (2013.01)

USPC ..... 166/323; 166/332.8

(58) Field of Classification Search

USPC ..... 166/320, 323, 332.8

See application file for complete search history.

(56) References Cited

U.S. PATENT DOCUMENTS

| | | | | |
|---|---|---|---|---|
| 4,216,830 | A * | 8/1980 | Fredd | 166/319 |
| 2008/0245531 | A1 | 10/2008 | Noske | |
| 2009/0071654 | A1 | 3/2009 | O'Malley | |
| 2009/0230340 | A1 | 9/2009 | Purkis | |
| 2012/0298371 | A1 * | 11/2012 | Xu | 166/332.8 |

* cited by examiner

*Primary Examiner* — William P Neuder

(74) *Attorney, Agent, or Firm* — Thedford I Hitaffer; Hitaffer & Hitaffer, PLLC

(57) ABSTRACT

A wellbore valve assembly including a valve member which is moveable relative to the valve seat, the valve assembly being receivable in a wellbore tubing having a first end and a second end, the valve member being moveable between an open position relative to the valve seat, and a position in which the valve member is seated against the valve seat, the valve assembly including a valve member biasing device for biasing the valve member towards the open position, the valve member being operable to close in the event of a force which exceeds a predetermined value being applied in either direction relative to the direction in which the valve member biasing device acts.

31 Claims, 6 Drawing Sheets

WELLBORE VALVE ASSEMBLY

FIELD OF THE INVENTION

This application claims priority from UK application no. 1104893.1 filed on 23 Mar. 2011. The invention relates to a valve assembly for use in the drilling of a well bore, particularly, but not exclusively for oil and/or gas production.

DESCRIPTION OF THE PRIOR ART

In petroleum production, completion is the process of making a well ready for production (or injection), and includes the placement of certain well hardware. One of the main difficulties experienced is selectively plugging the tubing, in order to set a hydraulic packer. It is desirable to be able to maintain the tubing string open in order to permit auto-filling, circulation and/or displacing of the well, before plugging the tubing to enable the tubing to be pressurised so as to be able to set the hydraulic packer. Once the hydraulic packer has been set and tested, it is necessary to remove the plug to enable production and intervention. It is desirable, and in some cases a requirement, for the plug to be certified as a barrier for well control issues.

A conventional means of valve tubing to set hydraulic packers is to set a plug in landing nipples via a slick line (a thin non-electric cable for selective placement of well hardware). It is desirable to move away from the use of slick lines to reduce rig-time cost (particularly in deep water rigs with a high daily rate), and because the risk associated with landing and retrieving plugs in this manner is high.

Horizontal drilling is becoming increasingly popular, as it increases production and recovery. Therefore, there is a desire amongst the oilfield operators to complete wells in the horizontal section. A problem experienced when running a completion string in a horizontal section is that it is difficult to set a hydraulic packer. A slick line cannot be used to deploy a slick line plug because of the deviation of a horizontal section, and although a coiled tube can deploy a slick line plug, to do so is very expensive and in some cases, for example in the event of extreme reservoir contact, the coiled tube is unable to push the plug beyond a certain limit owing to excessive drag forces.

Suggested solutions to this problem include locating a ball seat in the completion string, below the desired position of the hydraulic packer. A ball is dropped from the surface, so as to land in the ball seat, such that pressure can be applied to set the packer. Once the hydraulic packer is set, the pressure in the tubing can be increased, so as to blow the ball and the ball seat out of the tubing string and into the wellbore. When production starts, there is an option of flowing the ball to the surface. One disadvantage of this method is that in long horizontal sections of tubing, the ball may not reach the ball seat, and hence the packer has to be positioned at a shallower position, to ensure that the ball reaches the seat. This may not always be an option. Furthermore, the formation experiences a sudden large increase in pressure in order to blow the ball and the seat through the tubing. This can be detrimental to production because of an increased skin factor, or because of a new fracture being introduced. In horizontal wells, there is no guarantee that the ball and the ball seat will exit the tubing string, which can lead to a blockage of the tubing. A reduction in the internal diameter of the tubing leads to a reduced flow rate, and can cause problems for well intervention at a later date. It is undesirable to leave a relatively large piece of "debris" in the well bore.

Another proposed solution is to locate a ceramic disc below the hydraulic packer. The tubing is filled from the surface whilst running in-hole and once the hydraulic packer is at the correct depth within the hole, pressure is applied from the surface to set the hydraulic packer. The ceramic disc also acts as a barrier. To start production, either sufficient pressure has to be applied to break the ceramic disc, or a slick line trip has to be completed to knock the ceramic disc out of position. A disadvantage of this method is that the tubing needs to be filled whilst running in-hole. There is no communication between the tubing and the annulus between the wellbore and the tubing, which can cause problems with well control. As with the ball and ball seat method, the application of a high enough pressure to break the disc can be detrimental to the wellbore. The use of a slick line to break the disc is restricted to wellbores having a relatively low deviation. This method cannot be used in a wellbore having a high deviation, including wellbores having horizontal sections. Furthermore if a slick line is required to break the disc, it would be more efficient to use slick line plugs. The disadvantages associated with that method are discussed above. Breaking such a disc using a slick line hammer does not necessarily remove the ceramic disc completely. Therefore the internal diameter of the tubing can be permanently reduced, which restricts flow during production and may cause problems with future well intervention.

A further suggested solution is a so-called "disappearing plug". This is a plug which is positioned below the hydraulic packer, and which disappears once the packer has been set. This may be achieved by chemically dissolving the packer by introducing a dissolving fluid from the surface and circulating the fluid through the tubing. Alternatively, a time-delay detonator may be triggered when a certain pressure is attained, to break the plug. This method has not been particularly successful. It is undesirable to introduce "foreign" chemicals or explosives into the wellbore. Furthermore this method is not cost effective.

SUMMARY OF THE INVENTION

According to a first aspect of the invention, there is provided a wellbore valve assembly including a valve member which is moveable relative to a valve seat, the valve assembly being receivable in a wellbore tubing having a first end and a second end, the valve member being moveable between an open position relative to the valve seat, and a position in which the valve member is seated against the valve seat, the valve assembly including a valve member biasing device for biasing the valve member in a first direction towards the open position, wherein the valve member is moveable against the biasing force, towards the seated position, in the event of a force which exceeds a first predetermined value being applied in generally the opposite direction to the biasing force applicable by the valve member biasing device, and wherein the valve member is movable against the biasing force, towards the seated position, in the event of a force which exceeds a second predetermined value being applied in generally the same direction as the biasing force applicable by the valve member biasing device.

The first predetermined value may be equal to the second predetermined value, and each may be equal to the maximum force applicable by the valve member biasing device.

The valve assembly may include an actuator with which at least a part of the valve member is engageable, and which is operable to counteract the biasing force of the valve member biasing device.

According to a second aspect of the invention, there is provided a wellbore valve assembly including a valve member which is moveable relative to a valve seat, the valve assembly being receivable in a wellbore tubing having a first end and a second end, the valve member being moveable between an open position relative to the valve seat, and a position in which the valve member is seated against the valve seat, the valve assembly including a valve member biasing device for biasing the valve member towards the open position, wherein the valve assembly includes an actuator which acts in a direction opposite to a biasing force applied by the valve member biasing device, to move the valve member towards the seated position, in the event of the pressure in the wellbore tubing exceeding a first predetermined value, and wherein the actuator is releasable in the event that the pressure in the wellbore tubing exceeds a second predetermined value, which is higher than the first predetermined value, such that the valve member is permitted to move towards the open position, under action of the valve member biasing device.

The valve seat of a valve assembly in accordance with either the first or the second aspect of the invention may be moveable relative to the wellbore tubing.

The valve seat may be moveable in a generally axial direction relative to the tubing.

A valve assembly in accordance with either the first or second aspect of the invention may include a biasing device for biasing the valve seat towards a first position relative to the tubing.

The valve member may be connected to and pivotable relative to the valve seat.

The actuator may be moveable in a generally axial direction relative to the tubing between a first position and a second position.

The valve assembly may include an actuator biasing device for biasing the actuator towards its first position relative to the tubing.

The valve assembly may include a first locking device for inhibiting the return of the actuator to its first position under action of the actuator biasing device after the actuator has moved to its second position.

The first locking device may be a locking dog.

The valve assembly may include a second locking device for inhibiting the return of the valve seat from its second position to its first position under action of the valve seat biasing device.

The second locking device may be a locking dog.

The valve member may be moveable between a first, partially open position relative to the valve seat, a second position in which the valve member is seated against the valve seat, and a third fully open position relative to the valve seat.

The valve member biasing device may bias the valve member towards the third, open position.

A maximum biasing force applicable by the actuator biasing device may be greater than the maximum biasing force applicable by the valve member biasing device, such that application of a force which is greater than the maximum force applicable by the valve member biasing device, in generally the same direction as the force applicable by the valve member biasing device, but which is smaller than the maximum force applicable by the actuator biasing device, causes relative movement between the valve seat and the actuator, such that the distance between the valve seat and the actuator decreases, such that the actuator urges the valve member towards the closed position relative to the valve seat.

The valve member biasing device may be at least one coil spring.

The valve assembly may include a valve member holder device for holding the valve member in its third, fully open position, to inhibit obstruction of an internal diameter of the tubing.

The valve member holder device may include a support connected to the tubing and an arm, the valve member holding device further including an arm biasing device for biasing the arm towards a first position, the biasing force applicable by the valve member biasing device being sufficient to overcome the biasing force applicable by the arm biasing device.

BRIEF DESCRIPTION OF THE DRAWINGS

The invention will now be described by way of example only with reference to the accompanying drawings, of which.

DESCRIPTION OF THE PREFERRED EMBODIMENTS OF THE INVENTION

Figure 1:
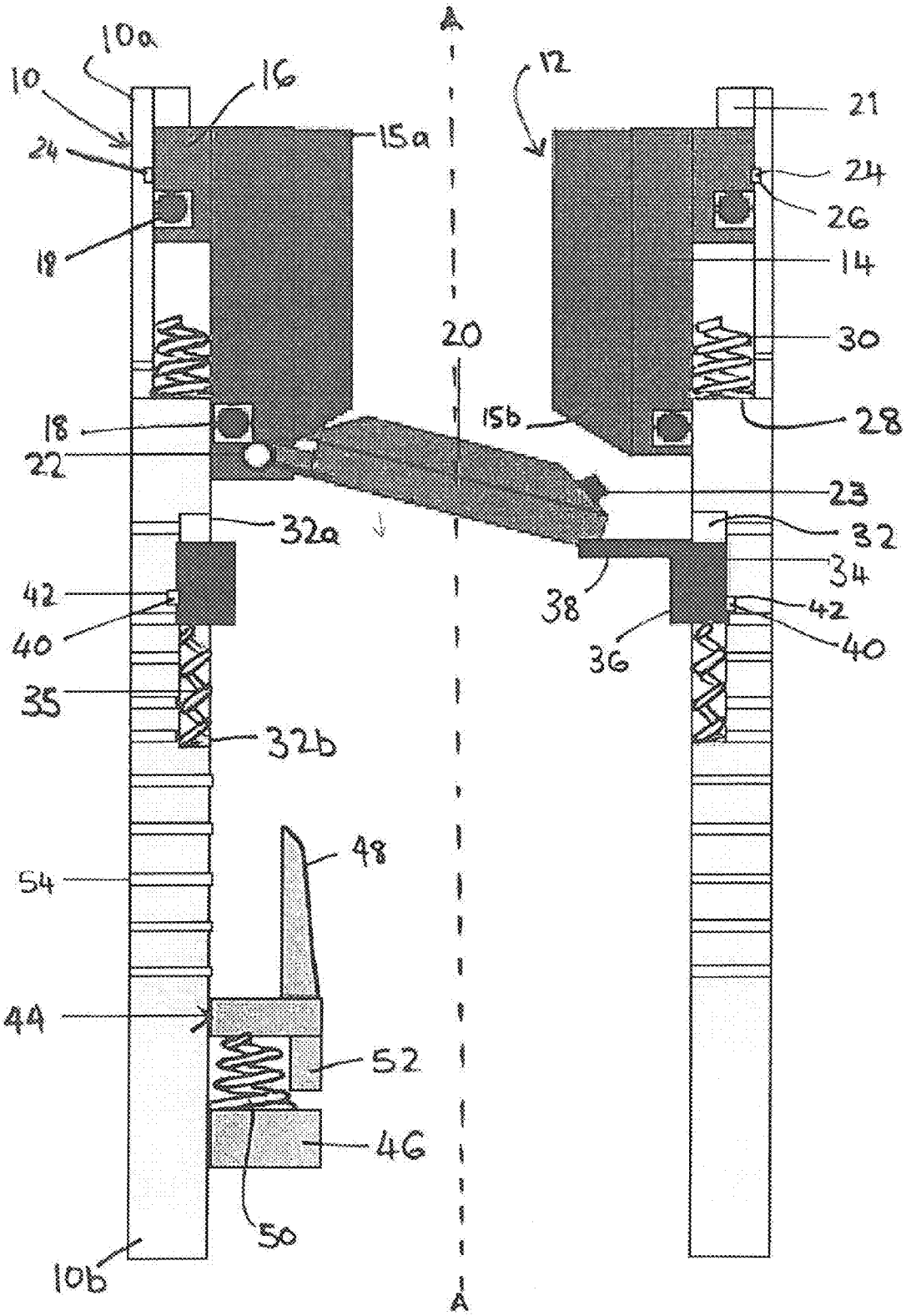
FIG. 1 shows a cross-sectional side view of a part of a wellbore tubing, including a valve assembly in a run in hole position.
Figure 2:
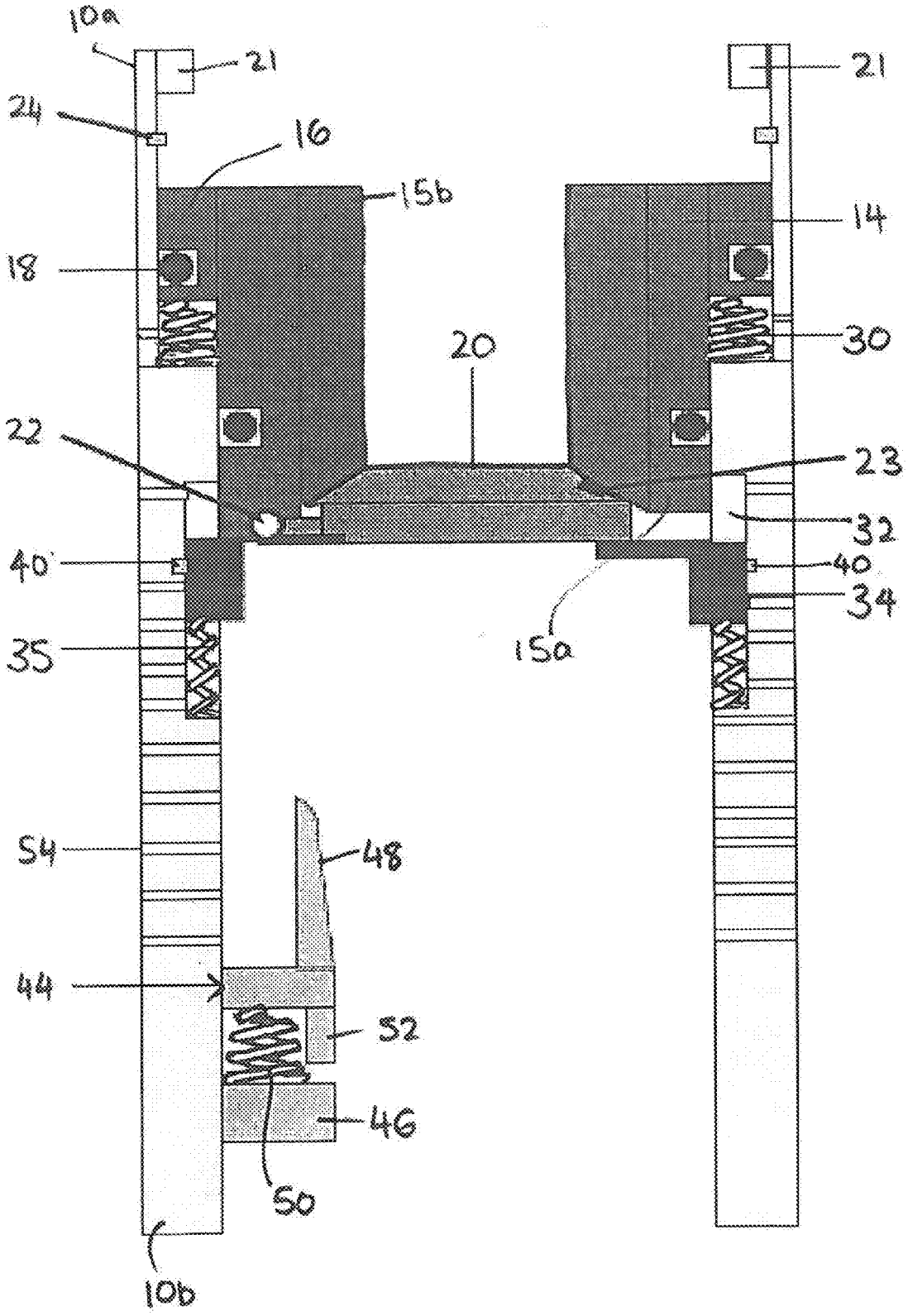
FIG. 2 shows the valve assembly in a hydraulic packer setting position.

Referring to the figures, there is shown a part of a wellbore tubing 10, in which is positioned a valve assembly 12 for selectively plugging the tubing 10, such that a hydraulic packer can be set, and which acts as a barrier for inhibiting backflow from a downhole formation, as well as selectively permitting substantially uninhibited flow through the tubing 10. The tubing 10 is substantially cylindrical having a first, upper end 10*a*, and a second, lower end 10*b*. The tubing 10 has a substantially longitudinal axis A.

The valve assembly 12 includes a valve seat 14 which is moveable between a first position and a second position relative to the tubing 10, and is hereinafter referred to as a floating flapper seat 14. The floating flapper seat 14 has a generally annular part 15, having a first end 15*a* and a second end 15*b*, and a shoulder part 16. The shoulder part 16 is positioned at the first end 15*a* of the generally annular part 15, and has an external diameter which is greater than an external diameter of the annular part 15. Each of the annular part 15 and the shoulder part 16 carries a seal 18, in the form of an o-ring, for sealing the floating flapper seat 14 against the tubing 10.

The valve assembly 12 also includes a valve member 20, hereinafter referred to as a flapper 20 which is carried by the floating flapper seat 14, at the second end 15*b* of the annular part 15. The flapper 20 is engageable with and sealable against the second end 15*b* of the annular part 15 of the floating flapper seat 14. The flapper 20 is connected to and pivotable relative to the floating flapper seat 14 by virtue of a flapper biasing device in the form of a coil spring 22. The flapper 20 is moveable between a first position in which the flapper is partially open, relative to the flapper seat 14, a second position in which the flapper 20 is fully seated and sealed against the flapper seat 14, and a third, fully open position in which the flapper 20 does not obstruct an internal diameter of the tubing 10.

The flapper 20 carries a regulator 23. The regulator 23 is operable to generate force to oppose the flapper 20 from seating against the floating flapper seat 14. Thus the regulator 23 is operable to exert a force on the flapper 20 to move the flapper 20 in a direction towards the second, lower end 10*b* of the tubing 10. In the example shown in the figures, the regulator applies a force in a generally clockwise direction.

A stationary seat 21 is positioned towards the first, upper end 10*b* of the tubing 10. The stationary seat 21 is a portion of the tubing 10 which has a smaller internal diameter than the part of the well tubing 10 which receives the shoulder 16 of the floating flapper seat 14, such that the floating flapper seat 14 is inhibited from moving beyond the stationary seat 21 in a direction towards the first end 10*a* of the tubing 10.

Figure 3:
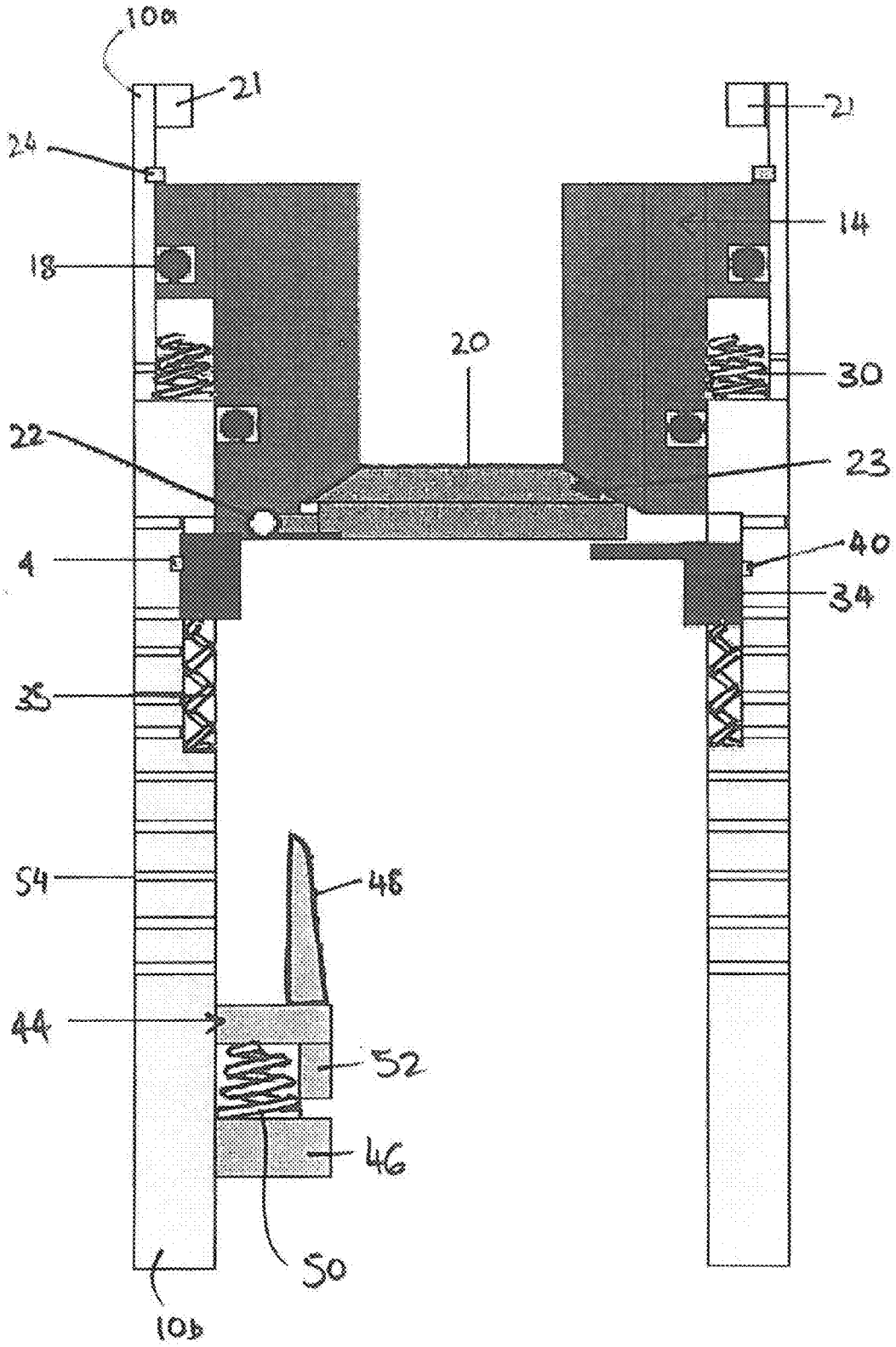
FIG. 3 shows the valve assembly operating as a barrier.
Figure 4:
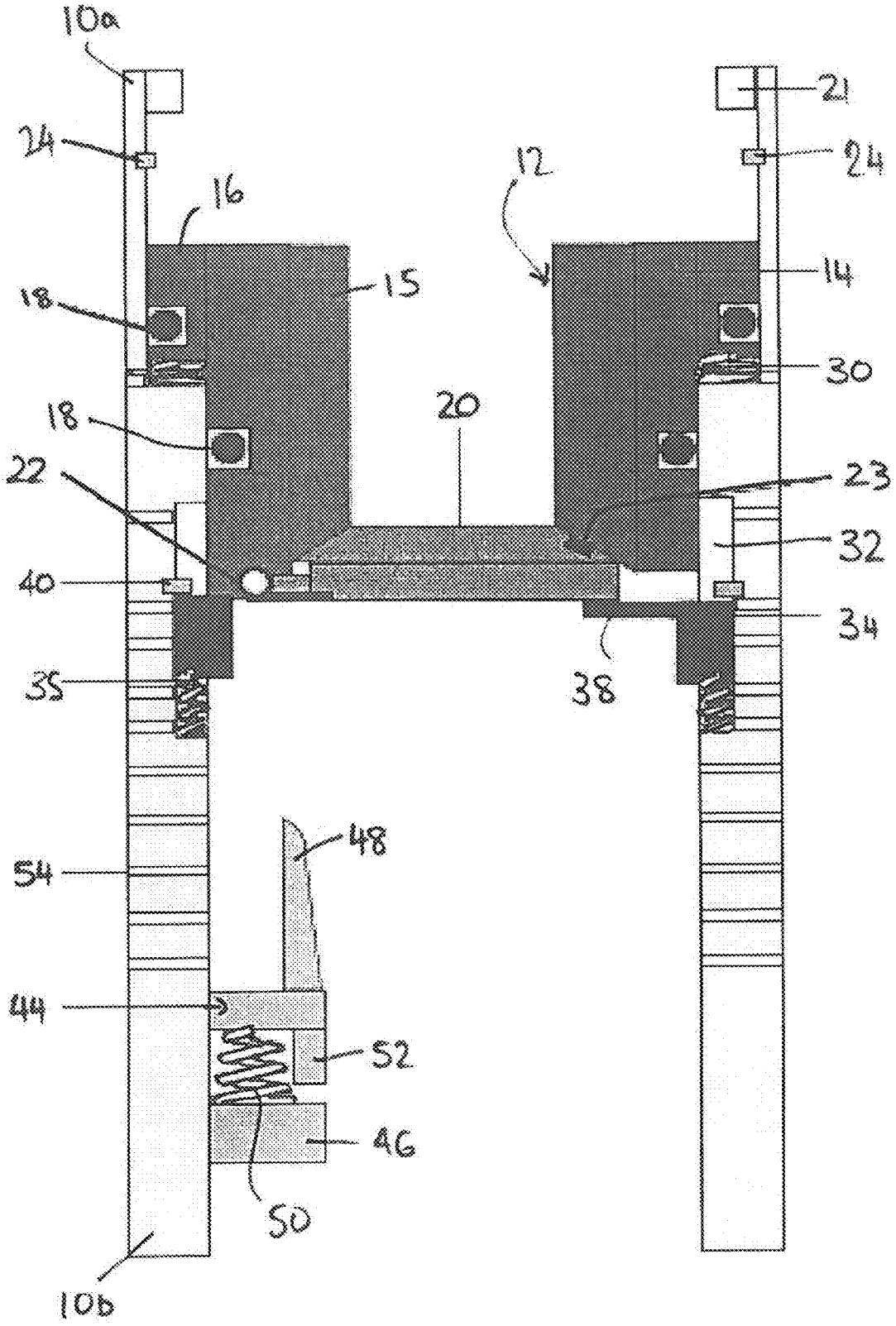
FIG. 4 shows a floating stopper of the valve assembly being locked in position relative to the tubing.

The tubing 10 carries at least one upper locking dog 24, towards the first end 10*a* of the tubing 10, but below the stationary seat 21. The present example shows a pair of upper locking dogs 24 which are diametrically opposed in the tubing 10, but it will be appreciated that any number of upper locking dogs 24 can be provided, preferably regularly circumferentially spaced about the tubing 10. The upper locking dogs 24 are resiliently biased towards a position in which each of the upper locking dogs 24 protrudes inwardly of the internal diameter of the tubing 10 (as shown in FIG. 3, for example). However, the or each upper locking dog 24 is receivable in a respective recess or opening 26 in an internal surface of the tubing 10.

The tubing 10 includes a seat 28 for receiving the shoulder part 16 of the floating flapper seat 14. The seat 28 is a substantially horizontal ledge which inhibits the shoulder 16 of the flapper seat 14 moving beyond the seat 28 in a direction towards the second end 10*b* of the tubing 10. A biasing device for biasing the floating flapper seat 14 away from the seat 28, in the form of a spring 30, extends generally upwardly from the seat 28 towards the shoulder 16 of the floating flapper seat 14.

The internal surface of the tubing 10 includes a circumferential recess 32 having a first, upper end 32*a* and a second, lower end 32*b*. An actuator, hereinafter referred to as a floating stopper 34 is received in and moveable along the recess 32 between a first position in which the floating stopper 34 is positioned towards the first upper end 32*a* of the recess 32, and a second position in which the floating stopper 34 is positioned towards the second end 32*b* of the recess 32. A biasing device in the form of a spring 35 is provided towards the second, lower end 32*b* of the recess 32, so as to bias the floating stopper 34 towards the first position.

The floating stopper 34 has a generally annular collar 36, and a projection 38 which extends generally radially inwardly towards the centre of the tubing 10. The circumferential position of the projection is such that it is generally opposite the position of the coil spring 22.

At least one lower locking dog 40 is provided in an internal wall of the recess 32. In this example a pair of lower locking dogs 40 are shown, but it will be appreciated that any number of lower locking dogs 40 may be provided. It is preferable for the lower locking dogs 40 to be regularly circumferentially spaced around the internal wall of the recess 32. The or each lower locking dog 40 is receivable in a corresponding opening 42 in the internal wall of the recess 32 and is resiliently biased generally radially inwardly, towards the centre of the tubing 10, such that it extends inwardly of the internal wall of the recess 32.

The tubing 10 also includes a flapper holding device 44, which is positioned towards the second, lower end 10*b* of the tubing 10. The flapper holding device 44 includes a support part 46 which is connected to and extends generally radially inwardly from the inner wall of the tubing 10. The flapper holding device 44 also includes an arm 48 which extends generally axially of the tubing 10, in a direction towards the first, upper end 10*a* of the tubing 10. The arm 48 is connected to a biasing device in the form of a spring 50 which extends generally upwardly from the support part 46 towards the first end 10*a* of the tubing 10. The arm 48 is moveable relative to the support part 46 and hence the tubing 10 by virtue of compression and extension of the spring 50. A stop element 52 extends generally downwardly towards the support part 46, for limiting the extent to which the arm 48 is movable towards the second end 10*b* of the tubing 10. It will be appreciated that the arm 48 may be biased away from the support part 46 by a device other than a spring 50, for example the flapper holding device 44 may include a gas charged piston, or any other mechanical, hydraulic or chemical biasing device.

The tubing 10 also includes a plurality of debris by-pass ports 54 as is generally known in the art for inhibiting the accumulation of debris in the tubing 10. The debris by-pass ports 54 may be any shape, for example circular, oval, square, etc. in cross-section, and may be of any structure, for example each may extend into the wall of the tubing 10 in a straight, helical or spiralled fashion.

During run in hole, the valve assembly 12 permits the tubing 10 to auto fill. The regulator 23 exerts a force on the flapper 20 so as to inhibit the flapper 20 from seating against the floating flapper seat 14, provided the flow rate across the flapper 20 does not exceed a predetermined value. During run in hole, the floating flapper seat 14 is seated against an underside of the stationary seat 21 and at least a part of the flapper 20 rests against the projection 38 of the floating stopper 34. The flapper 20 is thus inhibited from fully opening (see FIG. 1), and is held in its first, partially open position relative to the floating flapper seat 14, by virtue of its engagement with the floating stopper 34. The flapper 20 is pivotable about the flapper biasing device 22, and the fact that the projection 38 of the stopper 34 is positioned diametrically opposite the flapper biasing device 22, means that a part of the flapper 20 which is opposite the flapper biasing device 22 is permitted to contact the projection 38. The maximum force applicable by the floating stopper biasing device 35 is greater than the maximum force applicable by the flapper biasing device 22. During run in hole, the flapper biasing device 22 holds the floating flapper seat 14 in its first position, towards the first end 10*a* of the tubing 10.

However, if there is a sudden increase in fluid pressure at the bottom of the wellbore, for example because of a sudden leakage of fluids from a formation into the wellbore, and fluid flows back towards the first end 10*a* of the tubing 10 with a flow rate that exceeds the predetermined value, the fluid exerts a force which is sufficient to overcome the biasing force of the regulator 23, and causes the flapper 20 to seat and seal against the second end 15*b* of the annular part 15 of the floating flapper seat 14. Thus the valve assembly 12 provides a means of enabling auto-fill whilst also providing a well control mechanism or barrier in case the well flows back at an undesirable rate.

The provision of the floating stopper 34 ensures that the flapper 20 is inhibited from moving to its third fully open position until desired and is held in the first partially open position relative to the floating flapper seat 14, in relatively close proximity to the flapper seat 14, such that the flapper 20 is ready to close in the event that the well flows back at a higher than desirable rate. The flapper 20 is held in this partially open position by virtue of the co-operation of the flapper biasing device 22, the floating stopper biasing device 35 and the regulator 23. The upward and downward forces being applied by each of the biasing devices 22, 35 and the regulator 23 counteract one another. Therefore, unless a back-flow pressure, applied in a direction towards the first end 10*a* of the tubing 10 exceeds a predetermined limit, and is thus sufficient to overcome the force applied to the flapper 20 by the regulator 23, the flapper 20 will remain in the partially open position. During run-in-hole, the position of the flapper 20 will vary, oscillating back and forth, whilst fluid is flowing in the well.

This combination of holding the flapper 20 partially open and having a regulator 23 which defines a maximum permissible back flow rate, above which the flapper 20 is closed, is advantageous because auto-fill can be achieved whilst providing well control in the form of a barrier.

In order to set a hydraulic packer, the packer is inserted into the wellbore. When the hydraulic packer has reached the desired depth, it is necessary to increase the pressure in the tubing 10 in order to set the packer.

The cross-sectional area of the shoulder 16 of the floating flapper seat 14 is larger than the cross-sectional area of the second end 15*b* of the annular part 15 of the floating flapper seat 14. Therefore pressure of fluid in the tubing 10 acting upon the floating flapper seat 14 results in a greater force being exerted on the shoulder 16 of the floating flapper seat in a downward direction towards the second end 10*b* of the tubing 10 than a generally upward force exerted by an equivalent pressure being applied to the smaller cross-sectional area of the annular part 15 of the floating flapper seat 14, and when the pressure in the tubing 10 increases beyond a certain value, the net force generated acts in a generally downward direction.

When the net force exerted on the floating flapper seat 14 in a direction towards the second end 10*b* of the tubing 10 exceeds the maximum force applicable by the flapper biasing device 22, the floating flapper seat 14 moves in a generally downward direction relative to the tubing 10, towards the second end 10*b* of the tubing 10, such that the shoulder 16 moves towards the seat 28. The biasing force applicable by the stopper biasing device 35 is greater than the biasing force applicable by the flapper biasing device 22. Therefore the flapper 20 is pushed by the floating stopper 34. Thus, in the event of a downward force being applied which is greater than the maximum force applicable by the flapper biasing device 22, but which is less than the maximum force applicable by the floating stopper biasing device 35, the floating stopper 34 remains stationary relative to the tubing 10 whilst the floating flapper seat 14 moves downwards relative to the tubing 10. Since a part of the flapper 20 is engaged with the stopper 34, the flapper 20 is urged into engagement with the floating flapper seat 14.

The more the floating flapper seat 14 moves downwardly, towards the second end 10*b* of the tubing 10, the smaller the clearance between the floating flapper seat 14 and the flapper 20. This decreases the circulation area, and thus increases the pressure generated in the tubing 10. The flapper 20 is thus gradually brought into engagement with and seats and seals against the floating flapper seat 14. The floating flapper seat 14 moves downwardly relative to the tubing 10 towards the second end 10*b* of the tubing 10, until the floating flapper seat 14 reaches a second position relative to the tubing 10. When the floating flapper seat 14 is in its second position relative to the tubing 10, the floating flapper seat 14 no longer obstructs the upper locking dogs 24 and the upper locking dogs 24 move inwardly towards the centre of the tubing 10, so as to project inwardly of the internal surface of the tubing 10. Thus the floating flapper seat 14 is inhibited by the upper locking dogs 24 from returning from its second position relative to the tubing 10 to its first position relative to the tubing 10.

When the flapper 20 is seated and sealed against the floating flapper seat 14, as further pressure is applied, the generally downward force experienced by the floating flapper seat 14 is counteracted by the generally upwardly directed biasing force of the spring 35. The pressure necessary to set a hydraulic packer is preferably less than or equal to the upwardly directed biasing force of the spring 35, such that the downward force exerted as a result of pressure applied from the surface, which acts to move the floating flapper seat 14 and the flapper 20 downwardly, is balanced against the upward biasing force of the spring 35 whilst the hydraulic packer is being set.

This means that the lower locking dogs 40 are not released whilst the hydraulic packer is being set.

In the event of back flow from the formation, in a direction towards the first end 10*a* of the tubing 10, a force would be applied in a generally upward direction, towards the first end 10*a* of the tubing 10, thus urging the flapper 20 towards the floating flapper seat 14, and hence maintaining the flapper 20 seated against the floating flapper seat 14, such that the flapper 20 acts as a barrier.

In order to enable the flapper 20 to reopen, the pressure in the tubing above the valve assembly is further increased beyond the packer setting pressure, to result in a net downward force (in a direction towards the second end 10*b* of the tubing 10) which is larger than the force applicable by the spring 35. Such a force urges the floating flapper seat 14, the flapper 20 and the floating stopper 34 downwardly, towards the second end 10*b* of the tubing 10, against the biasing forces applicable by the springs 30, 25.

The movement of the stopper 34 towards the second end 32*b* of the recess 32 releases the lower locking dogs 40, since the stopper 34 no longer obstructs the lower locking dogs 40. Thus the lower locking dogs 40 move inwardly towards the centre of the tubing 10, so that each lower locking dog 40 protrudes inwardly from the internal surface of the tubing 10. The floating stopper 34 is henceforth prevented from returning to its first position relative to the tubing 10 by the lower locking dogs 40 (see FIG. 5).

Subsequent reduction of the pressure in the tubing 10 above the valve assembly, such that the force exerted on the floating flapper seat 14 in a direction towards the second end 10*b* of the tubing 10 is less than the upwardly directed biasing force applied by the spring 30, enables the floating flapper seat 14 to move upwardly relative to the tubing 10, towards the first end 10*a* of the tubing 10.

Since the floating stopper 34 is locked in position by the lower locking dogs 40, the distance between the floating flapper seat 14 and the stopper 34 increases. Therefore the flapper 20 is no longer held against the floating flapper seat 14 by the floating stopper 34.

Figure 5:
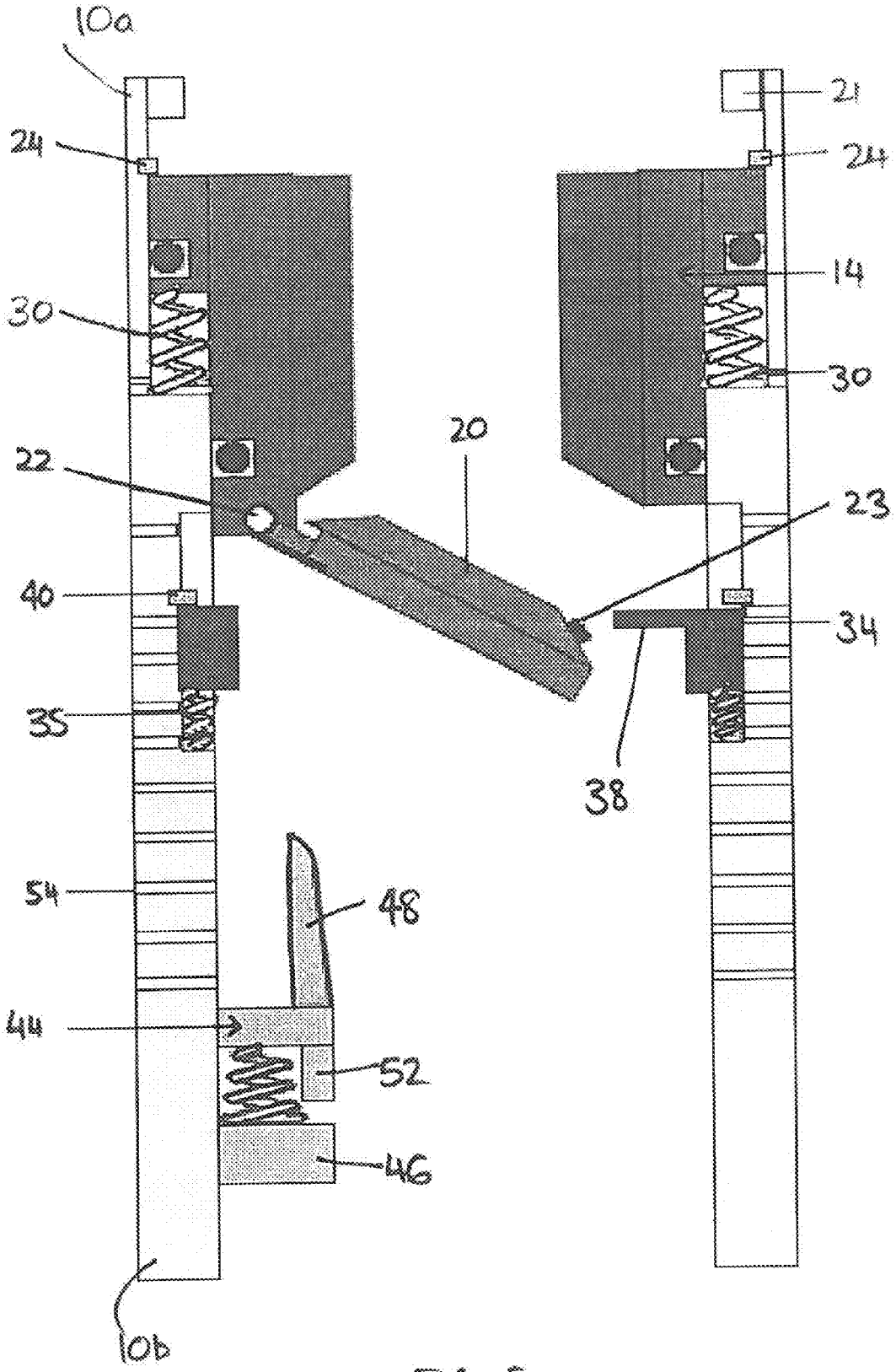
FIG. 5 shows a flapper of the valve assembly opening to permit flow through the tubing.
Figure 6:
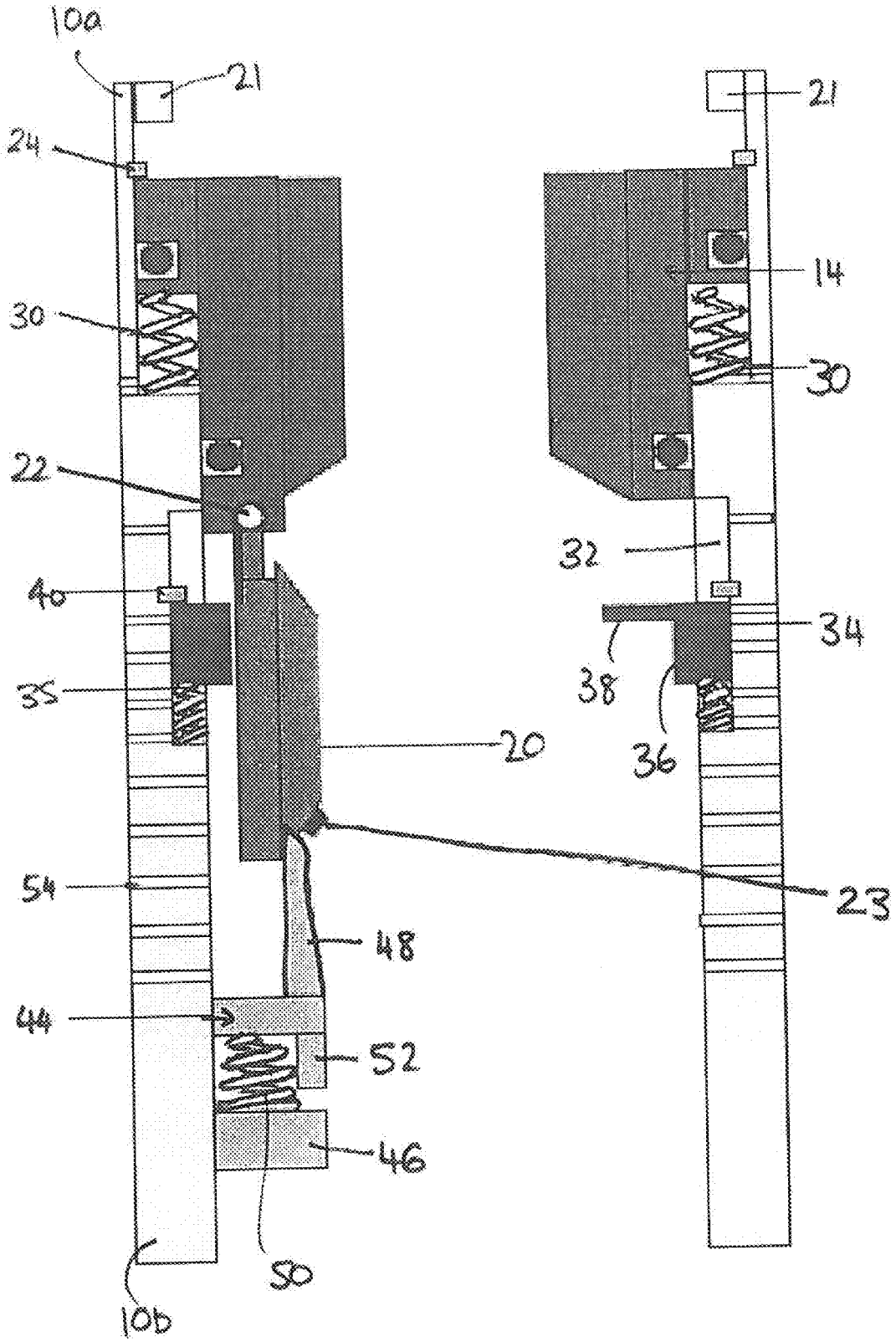
FIG. 6 shows the flapper being locked in position such that the flapper does not obstruct an internal diameter of the tubing.

The spring 22 biases the flapper 20 towards an open position relative to the floating flapper seat 14, the flapper 20 pivoting about the spring 22 relative to the floating flapper seat 14 (see FIG. 5). The spring 22 has sufficient strength to fully open the flapper 20, such that the flapper 20 depends substantially vertically from the floating flapper seat 14. Thus the internal diameter of the tubing 10 is substantially unobstructed by the flapper 20.

The flapper 20 is held permanently in the third fully open position for production, by the flapper holder device 44. The spring 22 urges the flapper 20 towards the fully open position, such that a part of the flapper 20 engages a free end of the arm 48. The biasing member 50 of the flapper holder device 44 enables the flapper to deflect the arm 48 of the flapper holder device 44, generally downwardly, such that the flapper 20 is permitted to move towards the inner surface of the tubing 10, beyond the position of the arm 48. The biasing member 50 returns the arm 48 to its original position, such that the arm 48 prevents movement of the flapper 20 in the opposite direction. Therefore the flapper 20 is permanently held in a fully open position, substantially against the inner surface of the tubing 10. The flapper holder device 44 is a "single-use" device in that the flapper 20 cannot return to the closed position once it is held by the flapper holding device 44.

Thus the invention permits auto-filling while running in hole, and acts as a check valve, i.e. a barrier which inhibits back flow from the formation into the tubing, the ability to circulate and displace while running in hole, the ability to set a packer when required, and an unobstructed internal diameter for and during production. The device is remotely hydraulically operated from the surface, the only requirement being the ability to control the pressure applied above the valve assembly. No slick line/coiled tube intervention is required to operate the proposed device.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A wellbore valve assembly including a valve member which is moveable relative to a valve seat, the valve assembly being receivable in a wellbore tubing having a first end and a second end, the valve member being moveable between an open position relative to the valve seat, and a position in which the valve member is seated against the valve seat, the valve assembly including a valve member biasing device for biasing the valve member in a first direction towards the open position, wherein the valve member is moveable against the biasing force, towards the seated position, in the event of a force which exceeds a first predetermined value being applied in generally the opposite direction to the biasing force applicable by the valve member biasing device, and wherein the valve member is moveable against the biasing force, towards the seated position, in the event of a force which exceeds a second predetermined value being applied in generally the same direction as the biasing force applicable by the valve member biasing device.

2. A valve assembly according to claim 1 wherein the first predetermined value is equal to the second predetermined value.

3. A valve assembly according to claim 2 wherein the first and second predetermined values are equal to the maximum force applicable by the valve member biasing device.

4. A valve assembly according to claim 1 including an actuator with which at least a part of the valve member is engageable, and which is operable to counteract the biasing force of the valve member biasing device.

5. A valve assembly according to claim 1 wherein the valve seat is moveable relative to the wellbore tubing.

6. A valve assembly according to claim 5 wherein the valve seat is moveable in a generally axial direction relative to the tubing.

7. A valve assembly according to claim 5 including a biasing device for biasing the valve seat towards a first position relative to the tubing.

8. A valve assembly according to claim 1 wherein the valve member is connected to and pivotable relative to the valve seat.

9. A valve assembly according to claim 4 wherein the actuator is moveable in a generally axial direction relative to the tubing between a first position and a second position.

10. A valve assembly according to claim 9 including an actuator biasing device for biasing the actuator towards the first position relative to the tubing.

11. A valve assembly according to claim 9 including a first locking device for inhibiting the return of the actuator to the first position under action of the actuator biasing device after the actuator has moved to the second position.

12. A valve assembly according to claim 11 including a second locking device for inhibiting the return of the valve seat from the second position to its first position under action of the valve seat biasing device.

13. A wellbore valve assembly according to claim 10 wherein the valve member is moveable between a first, partially open position relative to the valve seat, a second position in which the valve member is seated against the valve seat, and a third fully open position relative to the valve seat.

14. A valve assembly according to claim 13 wherein the valve member biasing device biases the valve member towards the third, open position.

15. A valve assembly according to claim 13 wherein a maximum biasing force applicable by the actuator biasing device is greater than the maximum biasing force applicable by the valve member biasing device, such that application of a force which is greater than the maximum force applicable by the valve member biasing device, in generally the same direction as the force applicable by the valve member biasing device, but which is smaller than the maximum force applicable by the actuator biasing device, causes relative movement between the valve seat and the actuator, such that the distance between the valve seat and the actuator decreases, such that the actuator urges the valve member towards the closed position relative to the valve seat.

16. A valve assembly according to claim 1 including a valve member holder device for holding the valve member in a third, fully open position, to inhibit obstruction of an internal diameter of the tubing.

17. A valve assembly according to claim 16 wherein the valve member holder device includes a support connected to the tubing and an arm, the valve member holding device further including an arm biasing device for biasing the arm towards a first position, the biasing force applicable by the valve member biasing device being sufficient to overcome the biasing force applicable by the arm biasing device.

18. A wellbore valve assembly including a valve member which is moveable relative to a valve seat, the valve assembly being receivable in a wellbore tubing having a first end and a second end, the valve member being moveable between an open position relative to the valve seat, and a position in which the valve member is seated against the valve seat, the valve assembly including a valve member biasing device for biasing the valve member towards the open position, wherein the valve assembly includes an actuator which acts in a direction opposite to a biasing force applied by the valve member biasing device, to move the valve member towards the seated position, in the event of the pressure in the wellbore tubing exceeding a first predetermined value, and wherein the actuator is releasable in the event that the pressure in the wellbore tubing exceeds a second predetermined value, which is higher than the first predetermined value, such that the valve member is permitted to move towards the open position, under action of the valve member biasing device.

19. A valve assembly according to claim 18 wherein the valve seat is moveable relative to the wellbore tubing.

20. A valve assembly according to claim 19 wherein the valve seat is moveable in a generally axial direction relative to the tubing.

21. A valve assembly according to claim 19 including a biasing device for biasing the valve seat towards a first position relative to the tubing.

22. A valve assembly according to claim 18 wherein the valve member is connected to and pivotable relative to the valve seat.

23. A valve assembly according to claim 18 wherein the actuator is moveable in a generally axial direction relative to the tubing between a first position and a second position.

24. A valve assembly according to claim 20 including an actuator biasing device for biasing the actuator towards the first position relative to the tubing.

25. A valve assembly according to claim 20 including a first locking device for inhibiting the return of the actuator to a first position under action of the actuator biasing device after the actuator has moved to a second position.

26. A valve assembly according to claim 25 including a second locking device for inhibiting the return of the valve seat from the second position to the first position under action of the valve seat biasing device.

27. A wellbore valve assembly according to claim 24 wherein the valve member is moveable between a first, partially open position relative to the valve seat, a second position in which the valve member is seated against the valve seat, and a third fully open position relative to the valve seat.

28. A valve assembly according to claim 27 wherein the valve member biasing device biases the valve member towards the third, open position.

29. A valve assembly according to claim 27 wherein a maximum biasing force applicable by the actuator biasing device is greater than the maximum biasing force applicable by the valve member biasing device, such that application of a force which is greater than the maximum force applicable by the valve member biasing device, in generally the same direction as the force applicable by the valve member biasing device, but which is smaller than the maximum force applicable by the actuator biasing device, causes relative movement between the valve seat and the actuator, such that the distance between the valve seat and the actuator decreases, such that the actuator urges the valve member towards the closed position relative to the valve seat.

30. A valve assembly according to claim 18 including a valve member holder device for holding the valve member in a third, fully open position, to inhibit obstruction of an internal diameter of the tubing.

31. A valve assembly according to claim 30 wherein the valve member holder device includes a support connected to the tubing and an arm, the valve member holding device further including an arm biasing device for biasing the arm towards a first position, the biasing force applicable by the valve member biasing device being sufficient to overcome the biasing force applicable by the arm biasing device.

* * * * *